US011725479B2

(12) United States Patent
Stolboushkin et al.

(10) Patent No.: US 11,725,479 B2
(45) Date of Patent: Aug. 15, 2023

(54) SYSTEM AND METHOD FOR PERFORMING A STRADDLE FRAC OPERATION

(71) Applicants: Eugene Stolboushkin, Houston, TX (US); Vikram Unnikrishnan, Houston, TX (US); Matthew Solfronk, Katy, TX (US)

(72) Inventors: Eugene Stolboushkin, Houston, TX (US); Vikram Unnikrishnan, Houston, TX (US); Matthew Solfronk, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 39 days.

(21) Appl. No.: 17/351,551

(22) Filed: Jun. 18, 2021

(65) Prior Publication Data

US 2022/0403713 A1 Dec. 22, 2022

(51) Int. Cl.
*E21B 34/10* (2006.01)
*E21B 33/124* (2006.01)

(52) U.S. Cl.
CPC ..... *E21B 34/10* (2013.01); *E21B 33/124* (2013.01); *E21B 2200/06* (2020.05)

(58) Field of Classification Search
CPC ..... E21B 34/10; E21B 33/124; E21B 2200/06
See application file for complete search history.

(56) References Cited

U.S. PATENT DOCUMENTS

| | | | | |
|---|---|---|---|---|
| 7,360,594 | B2 * | 4/2008 | Giroux | E21B 10/64 166/242.6 |
| 8,322,450 | B2 * | 12/2012 | Meijer | E21B 33/1295 166/387 |
| 9,869,157 | B2 * | 1/2018 | Sevadjian | E21B 33/134 |
| 2015/0337621 | A1 | 11/2015 | Melenyzer | |
| 2016/0186544 | A1 | 6/2016 | Greci et al. | |
| 2017/0226822 | A1 | 8/2017 | Silva et al. | |
| 2019/0257193 | A1 * | 8/2019 | Telfer | E21B 23/01 |

OTHER PUBLICATIONS

International Search Report and Written Opinion for International Application No. PCT/US2022/033716; International Filing Date Jun. 16, 2022; Report dated Sep. 29, 2022 (pp. 1-7).

* cited by examiner

*Primary Examiner* — Catherine Loikith
(74) *Attorney, Agent, or Firm* — Cantor Colburn LLP

(57) ABSTRACT

A frac system includes a first packer assembly having a first compression set packer and a first indexing member, and a second packer assembly arranged upstream of the first packer assembly. The second packer assembly includes a second packer, a second indexing member, a bypass inlet arranged upstream of the second packer, and a frac port arranged downstream of the second packer. The bypass inlet is fluidically connected to the frac port through a bypass flow path and is selectively opened without disengaging the second packer.

7 Claims, 6 Drawing Sheets

SYSTEM AND METHOD FOR PERFORMING A STRADDLE FRAC OPERATION

BACKGROUND

Straddle frac systems are currently used to perform fracturing operations. A straddle frac system includes coil tubing or work string that supports packers which are set to create isolated zones in a well bore. Each isolated zone is defined by a top packer and a bottom packer. A frac port is positioned between the top packer and the bottom packer. The frac port allows slurry to exit the coil tubing between the top and bottom packers to fracture the zone. The top and bottom packers are typically set in tension. That is, each packer is expanded when exposed to a tensile or pulling force.

Creating the tensile force typically includes multiple pick up and set down operations. That is, an anchor is set below the bottom packer and the work string is picked up to create the tensile force. After setting the bottom packer, tensile force is applied to set the top packer. The work string is kept in tension during the fracturing operation.

Unfortunately, several jurisdictions do not allow a work string to be kept in tension during operations or, for the work string to be moved without killing the well after setting the top and bottom packers. Without the ability to move the work string, operators are not able to create the fluid flows that can clear the zone from debris prior to initiating production. Accordingly, the industry would welcome a system that would allow the setting of packers without the need to maintain tension on a work string and a system that can bypass a top packer without the need to release tension.

SUMMARY

Disclosed is a frac system including a first packer assembly having a first compression set packer and a first indexing member, and a second packer assembly arranged upstream of the first packer assembly. The second packer assembly includes a second packer, a second indexing member, a bypass inlet arranged upstream of the second packer, and a frac port arranged downstream of the second packer. The bypass inlet is fluidically connected to the frac port through a bypass flow path and is selectively opened without disengaging the second packer.

Also disclosed is a method of bypassing packer including applying a compressive force to a packer, expanding the packer with the compressive force, applying a fluid force to a bypass sleeve to expose a bypass inlet, flowing a fluid through the bypass inlet and downhole of the packer, and discharging the fluid below of the packer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
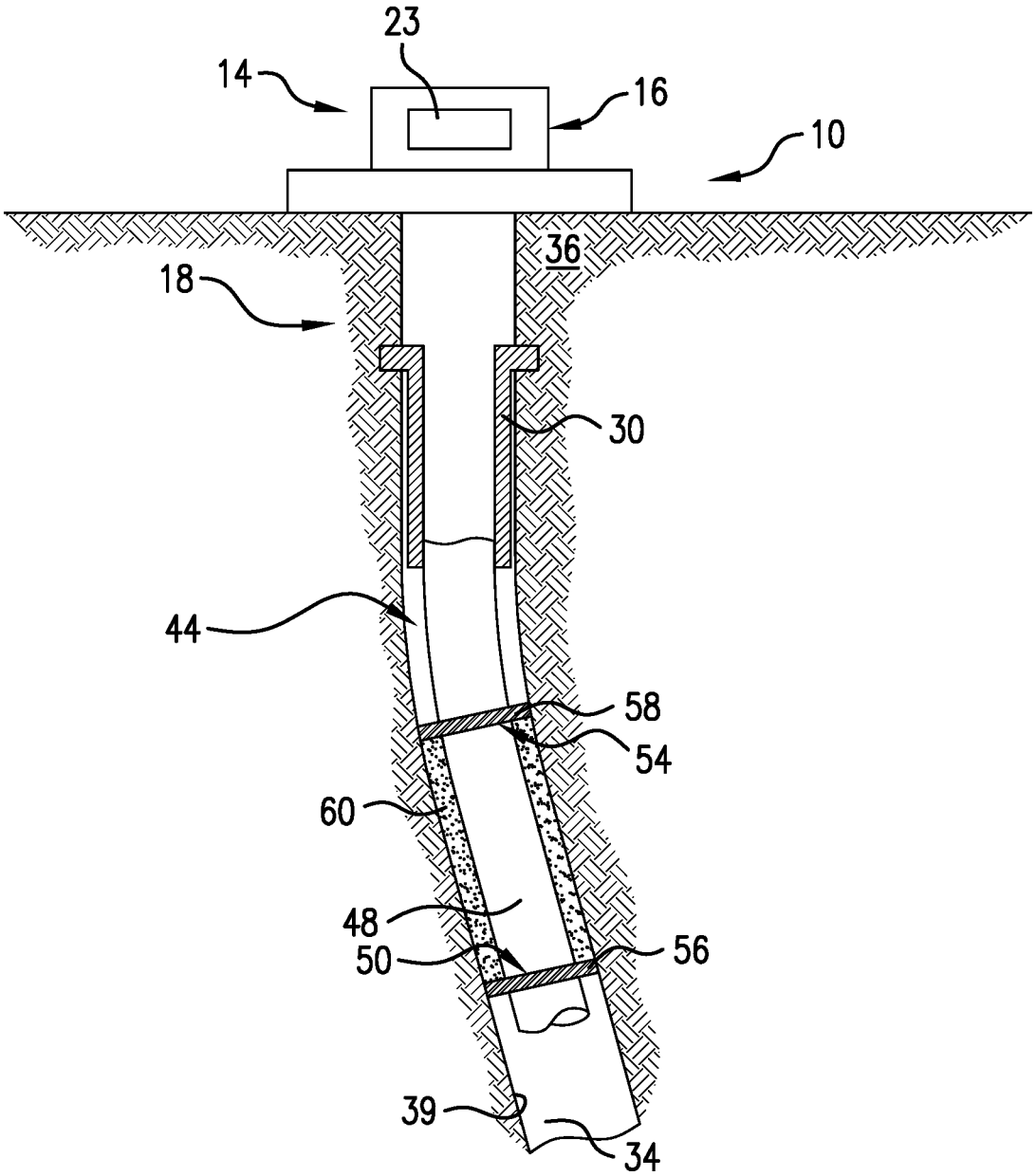
FIG. 1 depicts a resource exploration and recovery system including a frac system, in accordance with a non-limiting example.

A resource exploration and recovery system, in accordance with a non-limiting example, is indicated generally at 10 in FIG. 1. Resource exploration and recovery system 10 should be understood to support well drilling operations, completions, resource extraction and recovery, $CO_2$ sequestration, and/or the like. Resource exploration and recovery system 10 may include a first system 14 which, in some environments, may take the form of a surface system 16 operatively and fluidically connected to a second system 18 which, in some environments, may take the form of a subsurface or downhole system (not separately labeled).

First system 14 may include a control system 23 that may provide power to, monitor, communicate with, and/or activate one or more downhole operations as will be discussed herein. Surface system 16 may include additional systems such as pumps, fluid storage systems, cranes, and the like (not shown). Second system 18 may include a casing tubular 30 that extends into a well bore 34 formed in a formation 36 having a well bore surface 39.

In accordance with a non-limiting example, a frac system 44 extends into well bore 34. Frac system 44 may extend from surface system 16 or, in the non-limiting example shown, be anchored to casing tubular 30. In a non-limiting example, frac system 44 includes a first or bottom packer assembly 50 and a second or top packer assembly 54. At this point, while shown as including two subs, frac system 44 may also include a single sub as will become more fully evident herein. Bottom packer assembly 50 takes the form of a first compression set packer 56 and top packer assembly 54 includes a second compression set packer 58 between which may be defined a production zone (not separately labeled). An amount of proppant 60, such as sand, may be disposed in the production zone to support well bore surface 39.

Figure 2:
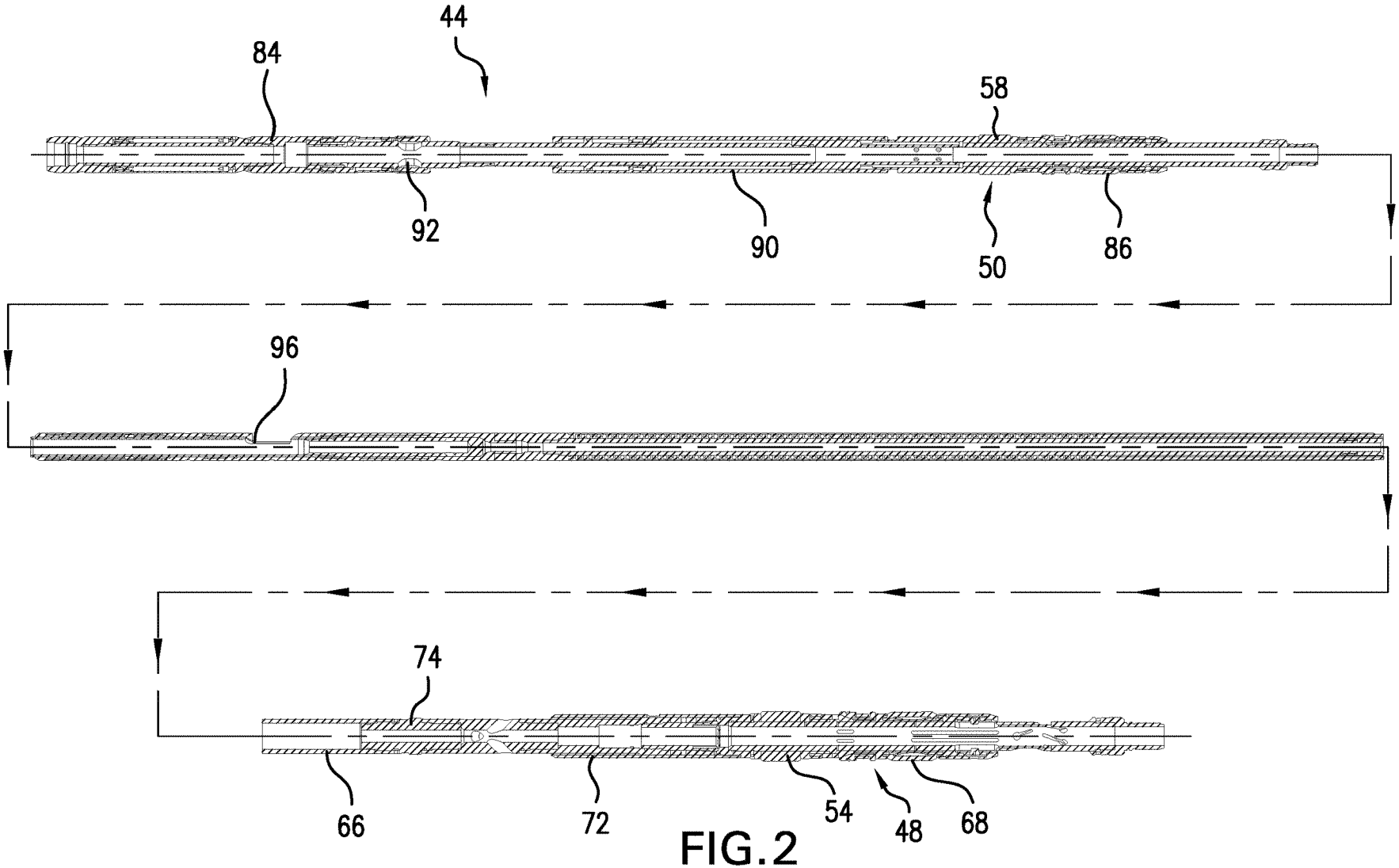
FIG. 2 depicts a top packer assembly and a bottom packer assembly of the frac system of FIG. 1, in accordance with a non-limiting example.

Referring to FIG. 2 and with continued reference to FIG. 1, bottom packer assembly 48 includes a first tubular 66 that supports a first anchor 68. First anchor 68 engages with well bore surface 39 to support frac system 44 at a bottom end thereof. Bottom packer assembly 48 is further shown to include a first selectively shiftable sleeve 72 operatively associated with a first indexing member 74 that may include a guide track (not shown) formed from a plurality of J-slots (also not shown). First selectively shiftable sleeve 72 is cycled axially relative to first indexing member 74 to, for example, radially outwardly expand first compression set packer 56. At this point, the phrase "cycled axially" should be understood to describe a reciprocating movement along a longitudinal axis defined by, for example, first tubular 66.

As further shown in FIG. 2, top packer assembly 50 includes a second tubular 84 that supports a second anchor 86. Second anchor 86 engages well bore surface 39 to support frac system 44 at an upper end thereof. Top packer assembly 50 also includes a second selectively shiftable sleeve or bypass sleeve 90 operatively associated with a second indexing member 92. As will be detailed herein, second selectively shiftable sleeve 90 is cycled axially relative to second indexing member 92 to expose a flow path for fluid to flow past second compression set packer 58 and into an annulus of well bore 34. The fluid may then re-enter frac system 44 through, for example, a frac port 96 arranged downhole of second compression set packer 58. The flow path is created without disengaging second compression set packer 58 from well bore surface 39.

Figure 3:
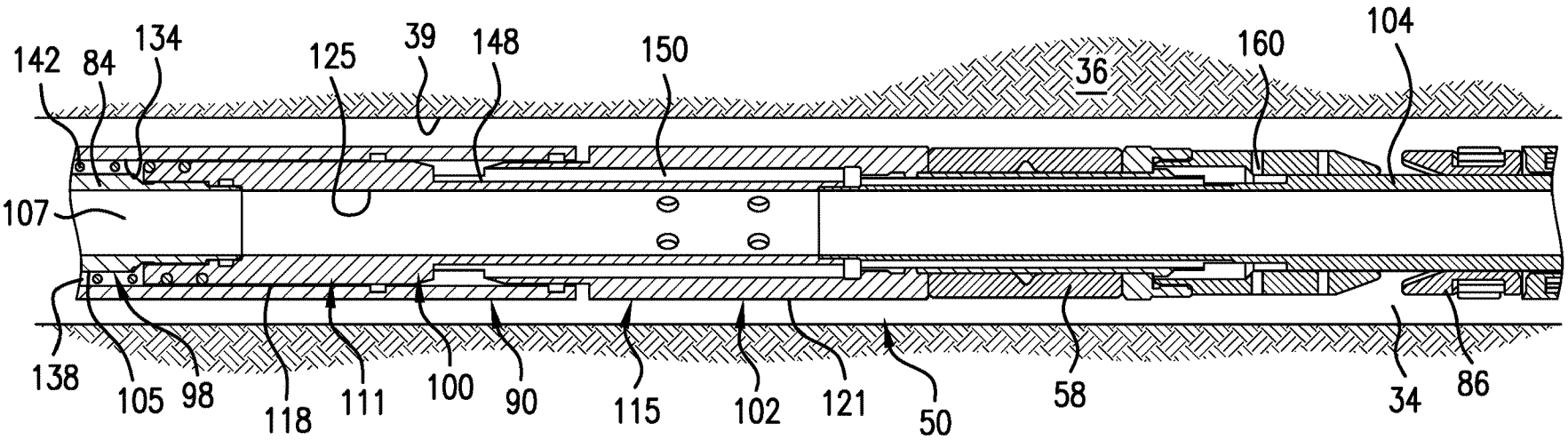
FIG. 3 depicts a partial cross-sectional view of the top packer assembly of FIG. 2 in a run-in configuration, in accordance with a non-limiting example.

Referring to FIG. 3, second tubular 84 includes a first portion 98, a second portion 100, a third portion 102, and a fourth portion 104. First, second, third, and fourth portions 98, 100, 102, and 104 may be separate components or could be different sections of the same component. First portion 98 includes a first outer surface 105 and a first inner surface 107. Second portion 100 includes a first section 111 and a second section 115.

Figure 4:
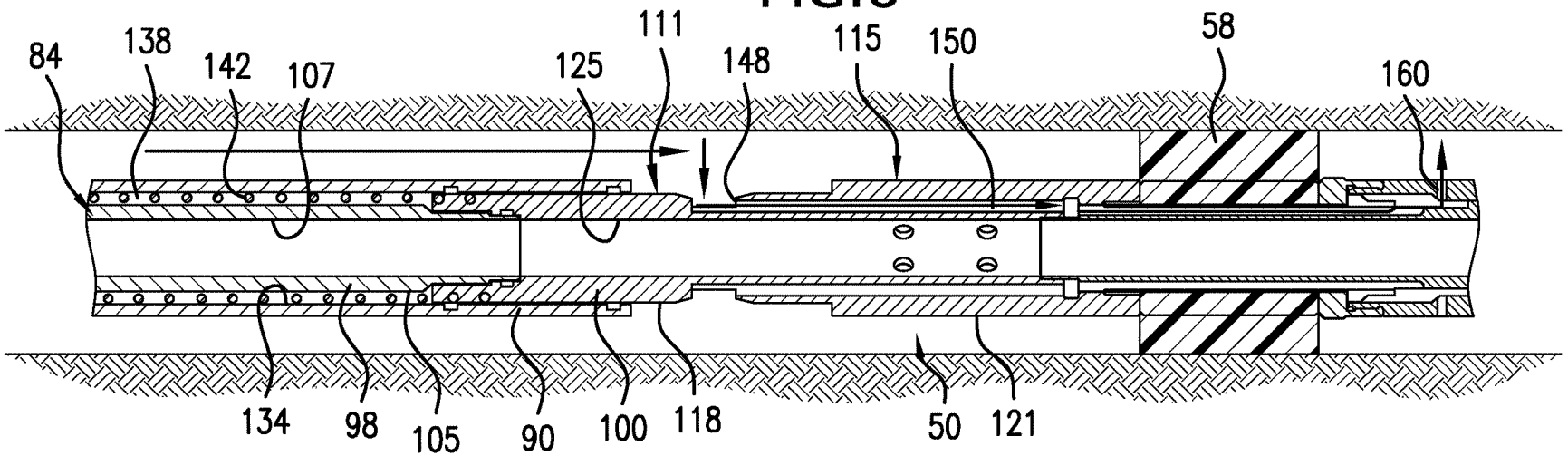
FIG. 4 depicts a partial cross-sectional view of the top packer assembly of FIG. 3 in a packer bypass configuration, in accordance with a non-limiting example.

First section 111 includes a second outer surface 118 having a first diameter and second section 115 includes a third outer surface 121 having a second diameter that is greater than the first diameter. Second section 115 may engage second compression set packer 58. An application of pressure to second section 115 will apply a compressive force to second compression set packer 58 causing a radially outwardly directed expansion as shown in FIG. 4. The radially outwardly directed expansion results in second compression set packer 58 engaging with well bore surface 39. Second portion 100 is also shown to include a second inner surface 125.

As further shown in FIG. 3, second selectively shiftable sleeve 90 includes an inner surface portion 134 that is spaced from first outer surface 105 of first portion 98 so as to define a spring chamber 138. A spring 142 is arranged in spring chamber 138. Spring 142 biases second selectively shiftable sleeve 90 axially away from second portion 100 in an uphole direction. As will be detailed herein, second selectively shiftable sleeve 90 cooperates with second indexing member 92 to selectively exposed a bypass inlet 148 without de-energizing or disengaging second compression set packer 58. Bypass inlet 148 leads to a bypass flow path 150 that extends along a longitudinal axis of second tubular 84 radially inwardly of third outer surface 121. Bypass flow path 150 extends into fourth tubular portion 104 to an outlet 160 arranged uphole of frac port 96.

Figure 5:
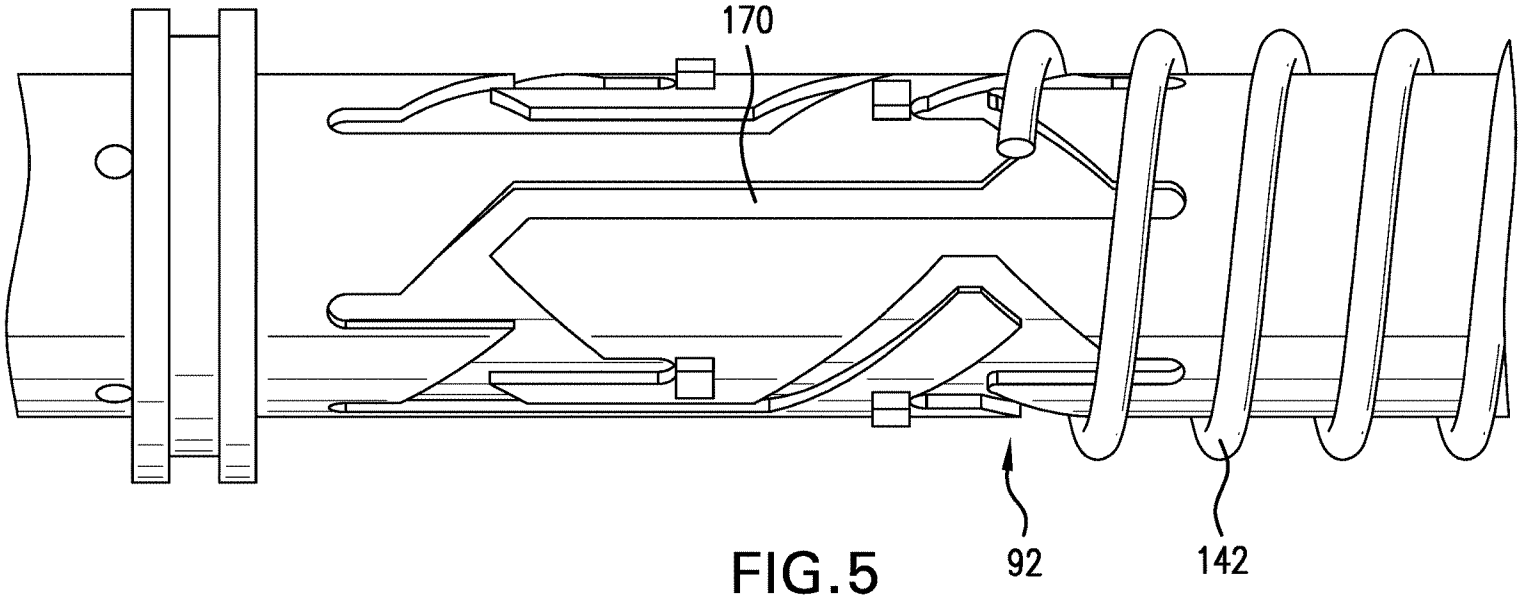
FIG. 5 depicts an indexing member of the top packer assembly of FIG. 2, in accordance with a non-limiting example.

In a non-limiting example shown in FIG. 5, second indexing member 92 includes a guide track 170. Guide track 170 is formed from a plurality of J-slots (not separately labeled) that extend annularly about second indexing member 92. Second selectively shiftable sleeve 90 is mechanically connected to an indexing follower 174 that transitions within guide track 170. The transitioning, caused by the application of pressure cycles, shifts second selectively shiftable sleeve 90 relative to second tubular 84 opening (exposing) and closing bypass inlet 148 to annular fluids. In this manner, fluids may be passed downhole without the need to disengage second compression set packer 58.

Figure 6:
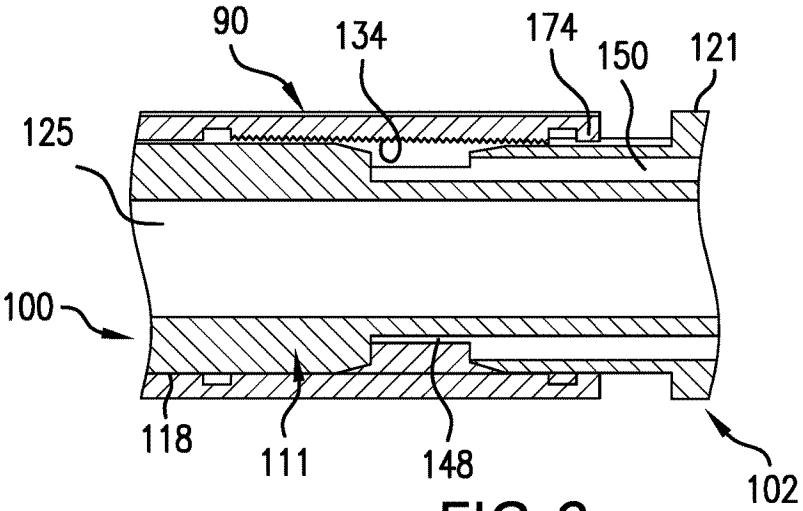
FIG. 6 depicts a cross-sectional view of the top packer assembly of FIG. 2 showing a bypass port in a closed configuration, in accordance with a non-limiting example.
Figure 7:
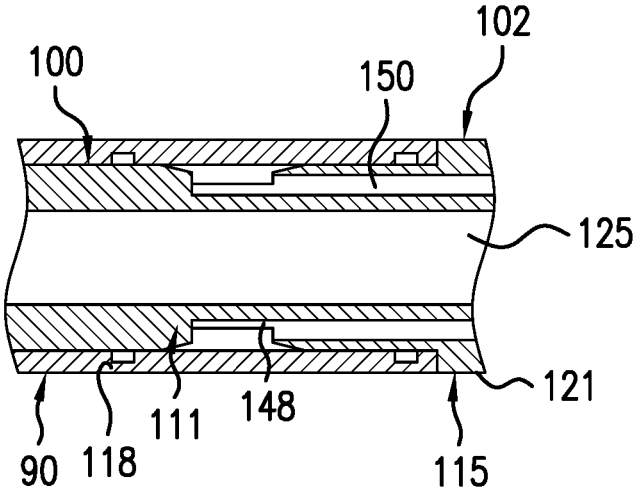
FIG. 7 depicts the bypass port of FIG. 6 transitioning to an open configuration, in accordance with a non-limiting example.

In accordance with a non-limiting example, frac system 44 is run into well bore 34 with bypass inlet 148 and bypass flow path 150 closed to annular fluids, as shown in FIG. 6. When in position and first and second anchors 68 and 86 are set, pressure is applied to frac system 44 causing second selectively shiftable sleeve 90 to shift downwardly and shoulder on second section 115 as shown in FIG. 7. Additional pressure may then be applied to set, second compression set packer 58 with a compressive force. Second compression set packer 58 will expand into contact with well bore surface 39.

Figure 8:
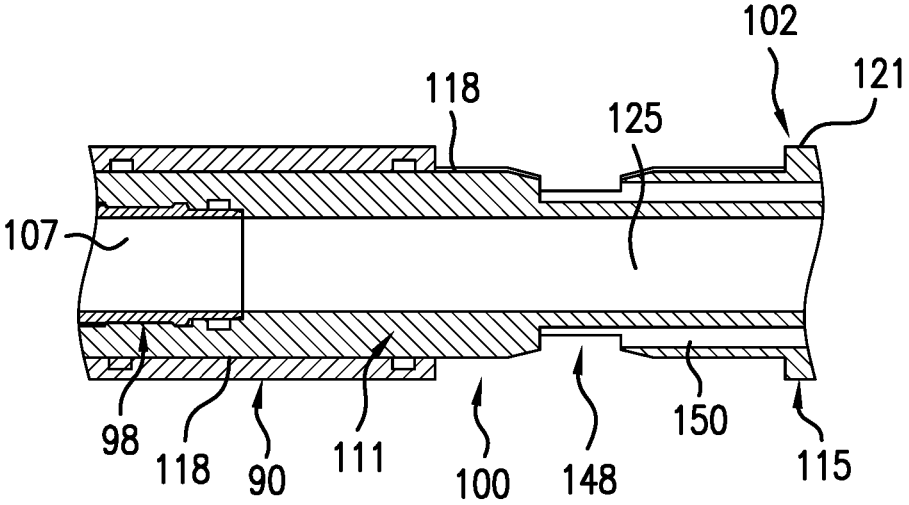
FIG. 8 depicts the bypass port of FIG. 7 in an open configuration.

At this point, a portion of the pressure may be alleviated such that spring 142 shifts second selectively shiftable sleeve 90 upwardly. The downward and upward shifting results in indexing follower 174 moving from a first portion (not separately labeled) to a second portion (also not separately labeled) of guide track 170. Second selectively shiftable sleeve 90 can them move further upward to expose bypass inlet 148 as shown in FIG. 8. The pressure alleviated allows second selectively shiftable sleeve 90 to shift but does not allow second compression set packer 58 to de-energize or disengage from well bore surface 39. At this point, fluids may be introduced into well bore 34 and allowed to flow through bypass flow path 150 radially inwardly of second compression set packer 58. The fluids may be employed for a fracturing operations or, for a well killing operation to set up additional movement of frac system 44.

Figure 9:
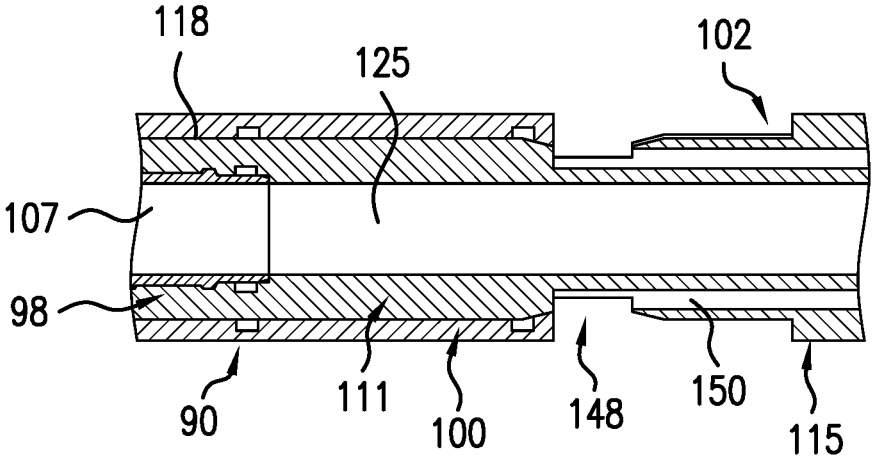
FIG. 9 depicts the bypass port of FIG. 8 transitioning to a closed configuration, in accordance with a non-limiting example.
Figure 10:
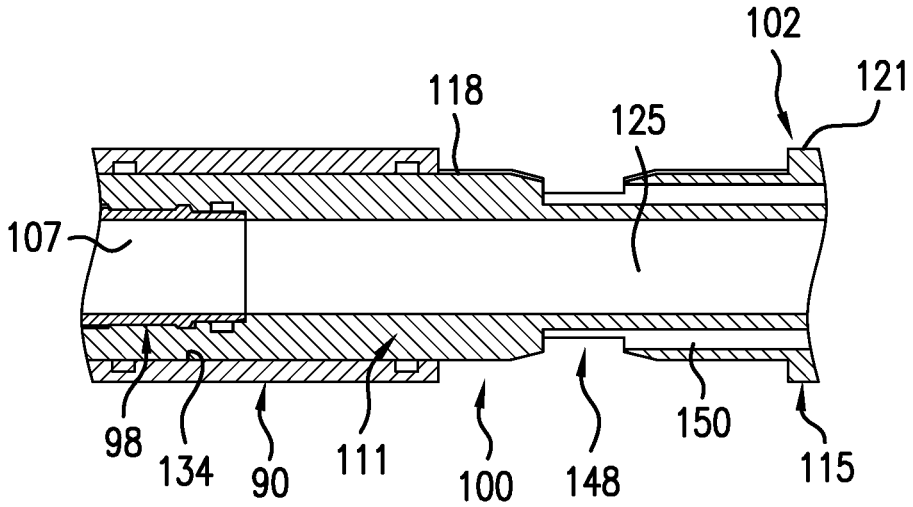
FIG. 10 depicts the bypass port of FIG. 9 further transitioning to the closed configuration, in accordance with a non-limiting example.
Figure 11:
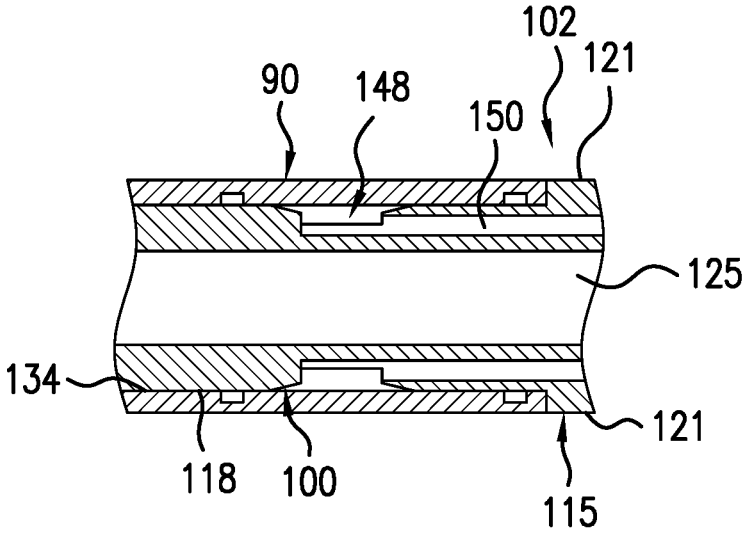
FIG. 11 depicts the bypass port of FIG. 10 in the closed configuration, in accordance with a non-limiting example.

When ready to move, pressure may be applied to frac system 42 to shift second selectively shiftable sleeve 90 downwardly as shown in FIG. 9 to index indexing follower 174. Pressure may then be removed allowing second selectively shiftable sleeve 90 to move upwardly allowing indexing follower to move to an adjacent one of guide tracks 170 as shown in FIG. 10. Pressure may be applied again causing second selectively shiftable sleeve 90 to cover bypass inlet 148 as shown in FIG. 11. Once bypass inlet 148 is closed, pressure may be completely removed allowing second compression set packer 58 to de-energize and disengage from well bore surface 39.

At this point, it should be understood that the non-limiting examples described herein present a frac system that employs compression set packers that can remain energized while, at the same time, fluid is run downhole for fracking and/or other well bore operations. Thus, the present invention allows a well to be killed before de-energizing packers prior to repositioning or withdrawing the frac system from the well bore.

Set forth below are some embodiments of the foregoing disclosure:

Embodiment 1: A frac system includes a first compression set packer and a first indexing member, and a second packer assembly arranged upstream of the first packer assembly, the second packer assembly including a second packer, a second indexing member, a bypass inlet arranged upstream of the second packer and a frac port arranged downstream of the second packer, wherein the bypass inlet is fluidically connected to the frac port through a bypass flow path and is selectively opened without disengaging the second packer.

Embodiment 2: The frac system according to any previous embodiment wherein the second packer assembly includes a tubular having a first portion supporting the second indexing member, the first portion includes a first outer surface and a first inner surface.

Embodiment 3: The frac system according to any previous embodiment wherein the tubular includes a second portion including a first section having a second outer surface including a first diameter and a second section having a third outer surface including a second diameter that is greater than the first diameter.

Embodiment 4: The frac system according to any previous embodiment further comprising a selectively shiftable sleeve disposed about the first portion and the second portion of the tubular.

Embodiment 5: The frac system according to any previous embodiment wherein the selectively shiftable sleeve includes an inner surface portion that is spaced from the first portion of the tubular.

Embodiment 6: The frac system according to any previous embodiment wherein the inner surface portion includes a constant inner diameter.

Embodiment 7: The frac system according to any previous embodiment further comprising a spring cavity defined between the inner surface portion and the second outer surface.

Embodiment 8: The frac system according to any previous embodiment further comprising a spring arranged in the spring cavity, the spring biasing the selectively shiftable sleeve toward the second indexing member.

Embodiment 9: The frac system according to any previous embodiment further comprising an indexing follower operatively connected to the selectively shiftable sleeve, the indexing follower being arranged in a guide track of the second indexing member.

Embodiment 10: The frac system according to any previous embodiment wherein the selectively shiftable sleeve selectively extends over the bypass inlet.

Embodiment 11: The frac system according to any previous embodiment wherein the third outer surface engages the second packer.

Embodiment 12: The frac system according to any previous embodiment wherein the bypass flow path extends radially inwardly of the third outer surface.

Embodiment 13: A resource exploration and recovery system includes a well bore in a subsurface formation, a string in the well bore; and a frac system according to any previous embodiment disposed in the well bore and connected to the string.

Embodiment 14: The method of bypassing a packer includes applying a compressive force to a packer, expanding the packer with the compressive force, applying a fluid force to a bypass sleeve to expose a bypass inlet, flowing a fluid through the bypass inlet and downhole of the packer, and discharging the fluid below of the packer.

Embodiment 15: The method of any previous embodiment wherein applying the fluid force to the bypass sleeve includes compressing a spring.

Embodiment 16: The method of any previous embodiment further comprising shifting the bypass sleeve between a first position and a second position on a tubular with the fluid force.

Embodiment 17: The method of any previous embodiment wherein shifting the bypass sleeve includes transitioning a follower through a track system to establish a position of the bypass sleeve relative to the tubular.

Embodiment 18: The method of any previous embodiment wherein shifting the bypass sleeve includes moving the bypass sleeve relative to the tubular exposing the bypass inlet.

Embodiment 19: The method of any previous embodiment wherein exposing the bypass inlet opens a flow path defined radially inwardly of the packer.

Embodiment 20: The method of any previous embodiment wherein flowing the fluid includes passing the fluid along the flow path into gun ports formed in the tubular.

Embodiment 21: The method of any previous embodiment further comprising cycling the bypass sleeve to close the bypass inlet.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a well bore, and/or equipment in the well bore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of bypassing packer comprising:

applying a compressive force to a packer supported on a tubular including a central flow path, the tubular including a bypass inlet arranged uphole of the packer;

expanding the packer with the compressive force;

applying a fluid force to a bypass sleeve arranged on an outer surface of the tubular to expose the bypass inlet;

flowing a fluid through the bypass inlet into a bypass flow path arranged radially inward of the packer and radially outward of the central flow path;

passing the fluid downhole of the packer; and discharging the fluid below the packer.

2. The method of claim 1, wherein applying the fluid force to the bypass sleeve includes compressing a spring.

3. The method of claim 2, further comprising: shifting the bypass sleeve between a first position and a second position on a tubular with the fluid force.

4. The method of claim 3, wherein shifting the bypass sleeve includes transitioning a follower through a track system to establish a position of the bypass sleeve relative to the tubular.

5. The method of claim 3, wherein shifting the bypass sleeve includes moving the bypass sleeve relative to the tubular exposing the bypass inlet.

6. The method of claim 5, wherein flowing the fluid includes passing the fluid along the flow path into the tubular.

7. The method of claim 3, further comprising: cycling the bypass sleeve to close the bypass inlet.

* * * * *